United States Patent [19]

Pratt et al.

[11] Patent Number: 5,053,286

[45] Date of Patent: Oct. 1, 1991

[54] ALUMINUM-LEAD ENGINE BEARING ALLOY METALLURGICAL STRUCTURE AND METHOD OF MAKING SAME

[75] Inventors: George C. Pratt, Ann Arbor; Warren J. Whitney, Jr., Ypsilanti, both of Mich.

[73] Assignee: Federal-Mogul Corporation, Southfield, Mich.

[21] Appl. No.: 434,528

[22] Filed: Nov. 7, 1989

Related U.S. Application Data

[63] Continuation of Ser. No. 175,564, Mar. 31, 1988, abandoned, which is a continuation-in-part of Ser. No. 821,716, Jan. 23, 1986, Pat. No. 4,996,025.

[51] Int. Cl.[5] ..... B32B 15/10; C21C 21/00

[52] U.S. Cl. ..... 428/653; 148/11.5 Q; 148/415; 148/416; 148/437; 148/438; 148/439; 420/548; 420/554

[58] Field of Search ..... 428/653; 420/548, 554; 148/11.5, Q, 415–418, 437–440

[56] References Cited

U.S. PATENT DOCUMENTS

| | | | |
|---|---|---|---|
| 2,580,776 | 9/1958 | Hunter | 160/23.1 |
| 2,790,216 | 4/1957 | Hunter | 164/480 |
| 3,078,563 | 2/1961 | Gould et al. | 228/208 |
| 3,410,331 | 11/1968 | Miller et al. | 164/468 |
| 3,432,293 | 3/1969 | Michael et al. | 427/229 |
| 3,495,649 | 2/1970 | Waters et al. | 164/485 |
| 3,522,836 | 8/1970 | King et al. | 164/463 |
| 3,545,943 | 12/1970 | Miller et al. | 428/547 |
| 3,562,884 | 2/1971 | Webbere | 29/149.5 S |
| 3,580,328 | 5/1971 | Eppich et al. | 164/435 |
| 3,605,863 | 9/1971 | King | 164/156 |
| 3,667,823 | 6/1972 | Webbere | 384/276 |
| 3,827,882 | 8/1974 | Lloyd et al. | 420/537 |
| 4,069,369 | 1/1978 | Fedor et al. | 428/557 |
| 4,232,804 | 11/1980 | Lewis et al. | 222/591 |
| 4,303,181 | 12/1981 | Lewis et al. | 222/591 |
| 4,333,775 | 6/1982 | Mahrus | 148/11.5 Q |
| 4,479,528 | 10/1984 | Maringer | 164/423 |
| 4,484,614 | 11/1984 | Maringer | 164/463 |
| 4,489,773 | 12/1984 | Miller | 164/463 |

FOREIGN PATENT DOCUMENTS

| | | | |
|---|---|---|---|
| 0040071 | 11/1981 | European Pat. Off. . | |
| 2263268 | 12/1972 | Fed. Rep. of Germany | 420/554 |
| 59-107056 | 6/1984 | Japan | 420/554 |
| 349746 | 9/1972 | U.S.S.R. | 420/554 |
| 1339 | of 1910 | United Kingdom . | |
| 540247 | 10/1941 | United Kingdom . | |
| 2148764 | 6/1985 | United Kingdom . | |
| 2185041 | 7/1987 | United Kingdom . | |

*Primary Examiner*—Peter D. Rosenberg
*Attorney, Agent, or Firm*—Lawrence J. Shurupoff

[57] ABSTRACT

An aluminum-lead bearing alloy in continuously cast strip form has a lead content in excess of 1% by volume, 4% by weight. The lead phase consists of uniformly distributed spherical particles no more than 25 microns in diameter, and the content of all other constituents other than aluminum totals not more than 10% by weight, the balance being aluminum. The alloy is used in engine bearings wherein an aluminum-lead alloy lining is bonded to a steel backing.

9 Claims, 3 Drawing Sheets

ALUMINUM-LEAD ENGINE BEARING ALLOY METALLURGICAL STRUCTURE AND METHOD OF MAKING SAME

This application is a continuation of application Ser. No. 175,564, filed Mar. 31, 1988, now abandoned, which is a continuation-in-part of application Ser. No. 821,716, filed Jan. 23, 1986, and now U.S. Pat. No. 4,996,025.

BACKGROUND OF THE INVENTION

This invention relates to an engine bearing alloy composed primarily of aluminum and lead which has a microstructure typified by fineness and uniformity of the lead phase previously unattainable in a product originating as cast strip. This invention also involves the method of making the alloy so as to obtain the desirable metallurgical microstructure. This method involves casting the alloy in strip form using a high quench rate process.

Most engine bearing alloys have a metallurgical microstructure consisting of a soft, low-melting-point phase uniformly distributed throughout a relatively hard and strong matrix. The soft phase consists of innumerable small islands of the order of 0.001–0.1 mm in size, which may or may not be interconnected. When the matrix is aluminum or aluminum strengthened by minor additions of alloying elements, the soft phase is commonly tin. The volume percentage of soft phase is 10–40% in the copper-lead system, and 2–20% in the aluminum-tin system. At the lower end of each range it is common practice to augment the bearing properties of the alloy by providing the bearing with a soft, thin overlay of a lead-base alloy.

Aluminum-lead is a desirable engine bearing alloy with good bearing properties. Moreover, lead is a less expensive metal than tin. The extent to which aluminum-lead had been adopted as an engine bearing alloy in practice, however, has been limited by the metallurgical problems associated with production of the alloy. In order to obtain a fine distribution of lead throughout an aluminum matrix it is first necessary to dissolve the lead in molten aluminum. The melt temperatures necessary to do this are much higher than are commonly used in aluminum casting practice. The higher the proportion of lead it is desired to incorporate, the higher must be the melt temperature. A greater difficulty arises during the cooling prior to solidification of the alloy. As the melt cools, lead is precipitated in the form of discrete droplets of molten lead. The specific gravity of these droplets is very much higher than that of the surrounding molten aluminum. Even though the molten aluminum still contains some lead in solution, its specific gravity is less than one quarter that of the molten lead droplets. The droplets, therefore, fall through the molten aluminum under the influence of gravity. When the aluminum freezes, a preponderance of lead is found at the bottom, while the top is denuded of lead. The desirable uniform distribution of lead has thus not been achieved.

Various methods of producing aluminum-lead bearing alloys have been proposed, some of which have been put into practice with varying degrees of success. These methods are briefly explained below.

One method (as shown in U.S. Pat. Nos. 3,410,331; 3,545,943; 3,562,884; 3,580,328; and 3,667,823) consists of dissolving lead in molten aluminum and horizontally continuous casting the alloy. The cast alloy is then rolled and roll-bonded to steel, and steel-backed bearings are formed from the resulting bimetal. Owing to the lead segregation phenomenon described above, the underside of the cast is lead-rich, the top side is denuded of lead and there is a lead gradient through the thickness of the cast. The low-lead side of the rolled alloy is used for bonding to the steel backing, the high lead side being partially removed during the machining of the bearing to its final dimensions. The amount of lead appearing in the machined bearing surface depends on the nature of the lead gradient in the as-cast alloy and on the thickness of the finished bearing lining relative to the as-bonded lining thickness. Achievement of a desirable known and constant lead content in the bearing surface requires very close control of the casting conditions such that the lead gradient has a constant value, and close control of the bonding conditions, such that the thickness reduction of the steel backing during bonding is known precisely. Such close control is in fact difficult to achieve in practice, and represents a significant drawback to the process. A further drawback is that the problem of controlling the lead gradient becomes more difficult as the percentage of lead incorporated in the melt is increased. Although U.S. Pat. No. 3,410,331 speaks of a process in which the lead content of the melt is up to 15% by weight (4% by volume),in practice the process has not been operated in production with lead contents above 6% by weight (1.5% by volume) because of the aforementioned difficulty. Yet a further drawback to the process is that the lead spheres in the as-cast alloy may be larger than desirable. A typical size range is 20–200 microns. During the rolling and roll-bonding processes the alloy is reduced in thickness by a factor of about ten to about twenty, and elongated by the same factor. The spherical lead particles may become elongated into ribbons 400–4000 microns in length. Lead in this form is considered undesirable for certain applications since it leads to a lowering of the fatigue strength of the bearing lining.

A second method is shown in U.S. Pat. No. 3,495,649 and consists of dissolving lead in molten aluminum and vertically continuously casting the alloy. Segregation of lead droplets occurs in this process also, the first alloy cast being lead-rich, and the last alloy cast being denuded of lead. In theory, equilibrium is achieved for the major part of the cast and, except for the beginning and the end, the alloy contains a uniform lead content. In practice, any change in the cooling conditions in the casting die results in a change in the rate of segregation and a variation in the lead content. For this and other metallurgical reasons, the process has not been put into production.

Another method (shown in U.S. Pat. No. 3,432,293) consists of dissolving lead in molten aluminum and solidifying while the melt is falling freely, like a waterfall, under the influence of gravity. Under such conditions there is no tendency for the lead to segregate and a uniform distribution of lead is in theory obtained. In practice, the problems of uniformly freezing a free-falling stream of molten aluminum are formidable, and the invention has not been realized in practice. Other proposals, such a solidifying the melt in space, away from the influence of the earth's gravitational field, have proved even more impracticable.

Yet another method (shown in U.S. Pat. No. 4,069,369) consists of dissolving lead in molten aluminum and atomizing a stream of the molten metal to powder. Each atomized particle freezes very quickly and the precipitated lead is distributed uniformly within each particle. The powder is then consolidated by rolling into a strip, which is sintered and roll-bonded to steel. The process produces an aluminum-lead bimetal lining without a lead gradient, but which still contains undesirable lead ribbons up to 500 microns in length. The process is, moreover, unattractive in that there are several process stages, making the overall process costs relatively high.

A final method consists of mixing aluminum and lead powders, together with other minor additions, in powder form, spreading the powder onto steel, roll compacting and sintering. There resultant bimetal strip lining has no lead gradient and contains no lead ribbons of significant length. The process economics are good. However, the fatigue strength of the alloy produced in this way is likely to be adversely affected because of the oxide coating on the individual aluminum-lead powder particles. Such bearings are considered suitable only for lightly loaded applications.

SUMMARY OF THE INVENTION

The present invention comprises a method of casting aluminum-lead alloys which suffers from none of the drawbacks associated with the above described prior art methods and which enables production of a cast and rolled aluminum-lead alloy product not having entrained oxide typical of aluminum product produced from powder metal. The process economics are good and the bimetal lining after bonding of the alloy has no lead composition gradient and contains lead ribbons which are much shorter than those produced by existing casting processes used for aluminum-lead alloys. The present invention also comprises a novel aluminum-lead microstructure with lead particles smaller by a factor of about 6 than are obtained by any other commercially practical casting process, such lead particles ranging from one to 25 microns in diameter and averaging 2 to 5 microns. Such a microstructure has been shown to increase the load-carrying ability of bearings made from the aluminum-lead material cast by the disclosed method.

DETAILED DESCRIPTION OF THE PREFERRED EMBODIMENT

Figure 1:
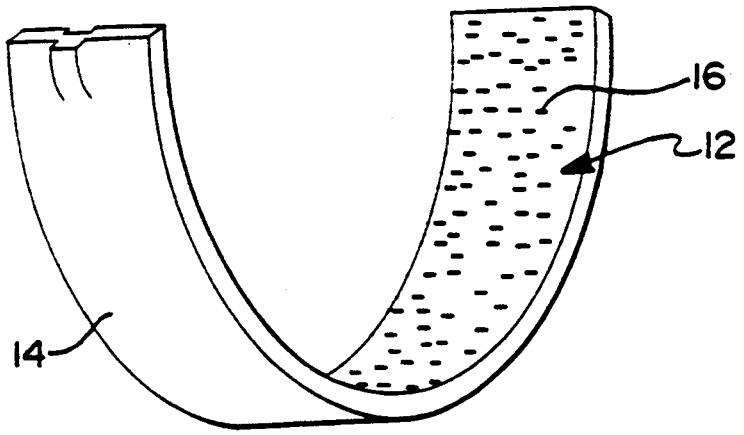
FIG. 1 is a perspective view of an engine bearing in accordance with the subject invention.

In FIG. 1 is shown a conventional bimetal engine bearing. Such a bearing in its most simple form comprises a semicylindrical bearing shell comprising a steel back (14) and a cast strip of bearing alloy (12) roll-bonded to the steel back. The roll bonding process is carried out with both the steel and the alloy in strip form, and bearings are subsequently formed from the bonded bimetal. Exposed lead particles in the subject aluminum-lead bearing alloy (12) are schematically shown at the bearing surface (16). The process of roll-bonding the cast alloy to the steel backing is shown and described in U.S. Pat. No. 3,078,563, assigned to the assignee of the subject invention, the teachings thereof being incorporated herein by reference.

The alloy is essentially comprised of aluminum and lead, with the lead being present from a minimum amount of not much less than 1.0% up to an amount no more than 4% by volume, 15% by weight, and preferably ranging from about 1.0–2.5% by volume, 4.0–10.7% by weight. Also added to the alloy may be a number of other constituents not to exceed a total of about 5%–10% by weight of the alloy, such constituents to include, for example, tin, silicon and strengthening additions such as manganese, magnesium and copper. Of particular importance is the addition of silicon in an amount of at least 2.5% to no more than 5.5% by weight. The silicon addition not only imparts wear resistance to the alloy, but it is also thought to abrasively polish certain minute surface imperfections commonly found in nodular iron crankshafts.

The process of casting the bearing alloy involves casting a thin strip of the aluminum-lead alloy between 1 and 10 mm in thickness, and preferably, due to limitations inherent in the commercial production process, between 4 and 7 mm in thickness, the rate of heat removal being such that the alloy temperature falls from about 850° C. to a freezing temperature (liquids) below 650° C. in less than one second. In practice in accordance with the process described herein this particular rate of heat removal has been accomplished in 0.5 to 1.0 seconds. Of course if it were possible, one would wish the freeze time to be instantaneous.

Figure 2:
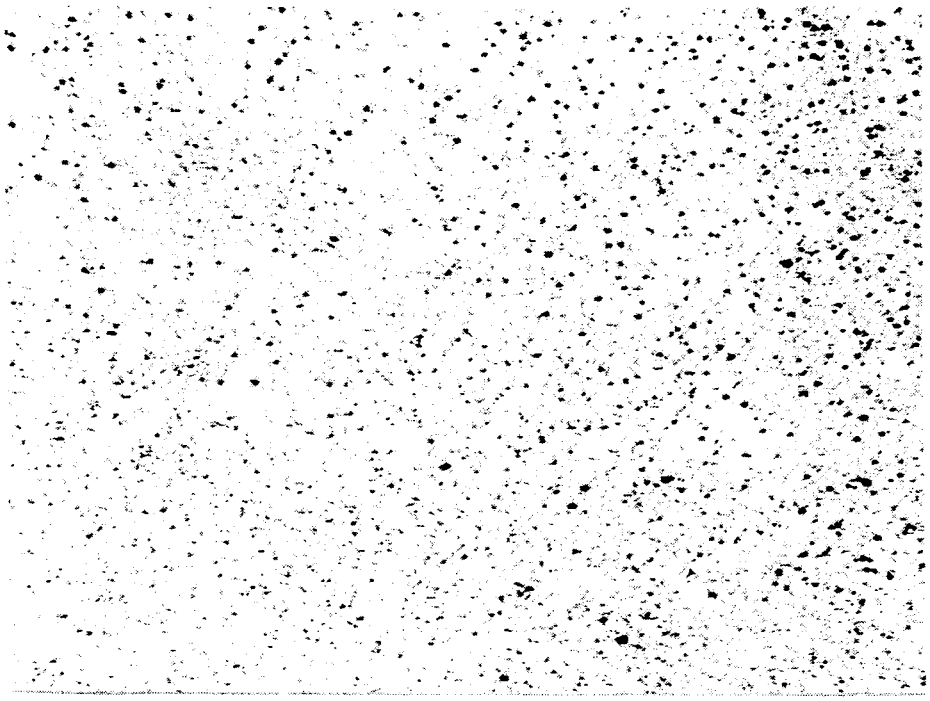
FIGS. 2 and 3 are photomicrographs of an as-cast aluminum-lead alloy, cast in accordance with the subject invention.
Figure 3:
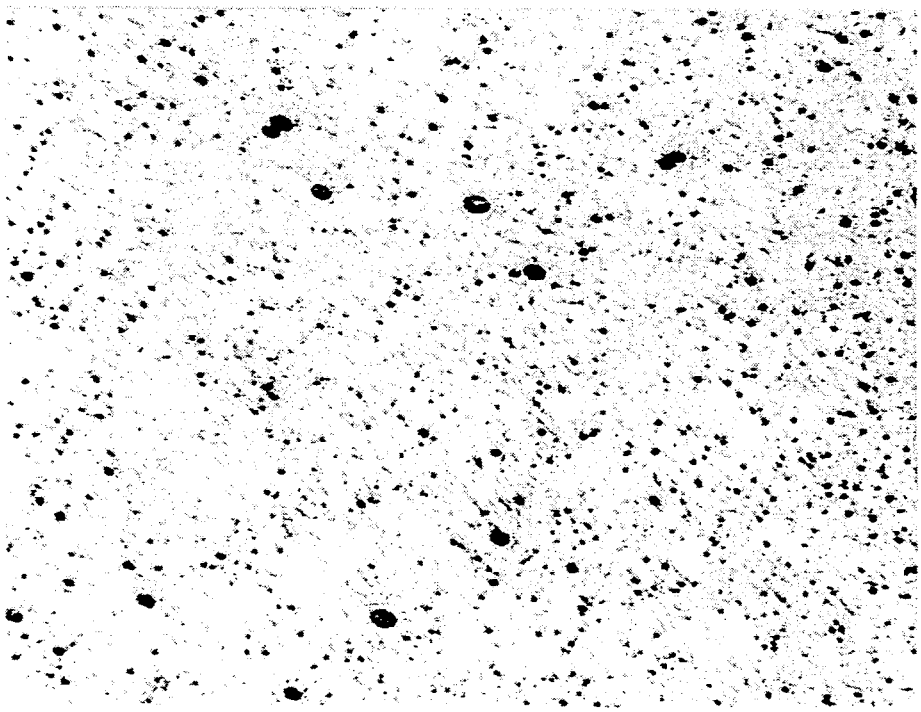
Figure 4:
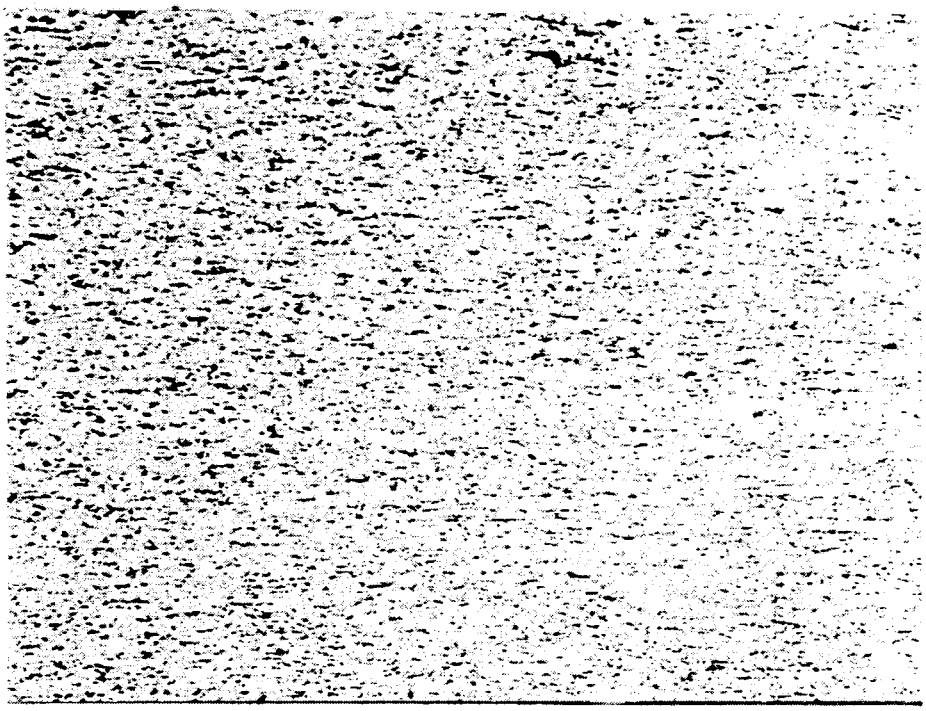
FIGS. 4 and 5 are photomicrographs of aluminum-lead alloy cast in accordance with the subject invention, after bonding to a steel backing for engine bearing manufacture.
Figure 5:
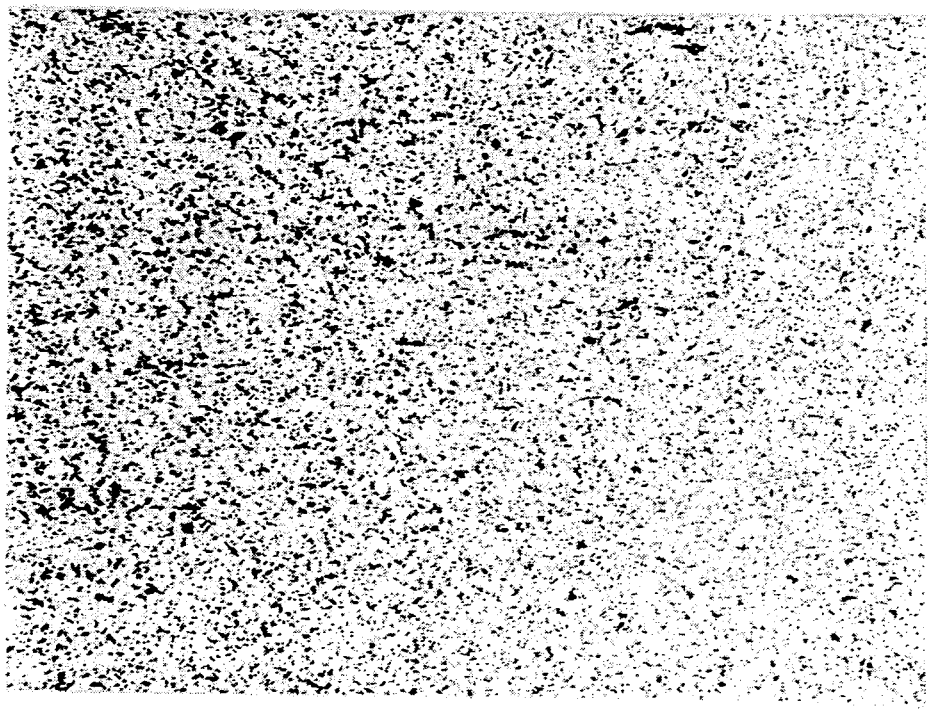

The microstructure obtained when the alloy is cast with such a high rate of cooling is illustrated in FIGS. 2 and 3. FIGS. 4 and 5 show the alloy after roll bonding to the steel backing. The maximum lead particle size in the as-cast condition is 25 microns in diameter. In contrast, the current commercial casting process familiar to the inventors for aluminum-lead alloys, namely that discussed above as one method under U.S. Pat. No. 3,410,331 and related identified U.S. patents, results in lead spheres with a maximum size of 125 microns under good conditions, and considerably larger than that when less-than-ideal conditions occur in the freezing area.

The particular alloy shown in all of FIGS. 2 through 5 has a composition comprising, by weight, 5% lead, 4% silicon, 0.5% tin, 0.3% manganese, 0.1% copper and 0.1% magnesium, the remainder aluminum, and traces of impurities.

The terminal velocity of a sphere falling under gravity through a liquid is given by the formula:

$$v = \frac{2r^2}{9e} g(ds - dl)$$

where r is the radius of the sphere, e is the viscosity of the liquid, g is the acceleration to gravity, ds is the density of the sphere and dl the density of the liquid.

The segregation velocity of a lead sphere 25 microns in diameter will thus be one twenty-fifth that of a particle 125 microns in diameter. This, combined with the short time, less than one second, in which segregation can occur ensures that the amount of lead segregation which occurs is extremely small.

Table 1 illustrates the difference in lead content and lead size between the top and bottom halves of horizontally continuously cast aluminum-lead alloy, one cast 6 mm thick and cooled from 850° to 650° C. in less than 1 second, the other cast 10.5 mm thick and cooled from 850° to 650° C. in 5 to 10 seconds in accordance with the aforementioned current commercial process.

TABLE 1

| | | |
|---|---|---|
| Cast Thickness (mm) | 6.0 | 10.5 |
| Cooling Time from 850° C. 05° C. (seconds) | <1 | 5-10 |
| Lead Content, % by weight | | |
| Top half | 4.5 | 2.6 |
| Bottom half | 4.2 | 7.0 |
| Lead Particle Size Range (microns) | | |
| Top Half | 0.5-12 | 2.5-25 |
| Bottom Half | 0.5-25 | 2.5-125 |
| Average Lead Particle Size (microns) | | |
| Top Half | 2 | 12 |
| Bottom Half | 5 | 25 |

The thin, rapidly cooled aluminum-lead alloy showed very little lead segregation towards the bottom of the cast (The fact that the bottom actually showed a lower lead content than the top is probably due to the margin of experimental error in the measurement technique). Comparing the top half of the two casts, the thin, rapidly cooled alloy showed a lead size smaller than that of the thicker, slowly cooled alloy by a factor of at least two. Comparing the bottom half of the two casts, the lead size in the thin, rapidly cooled alloy was finer by a factor of at least five.

Details of the casting processes used in the above examples are as follows:

| | Cast Thickness (mm) | |
|---|---|---|
| | 6.0 | 10.5 |
| Casting direction | Horizontal | Horizontal |
| Casting surface | Two rotating water-cooled copper-sleeved rolls. | Stationary graphite-die with water-cooled copper jacket. |
| Melt temperature, °C. | 970 | 970 |
| Casting speed, cm/min | 90 | 40 |

Figure 6:
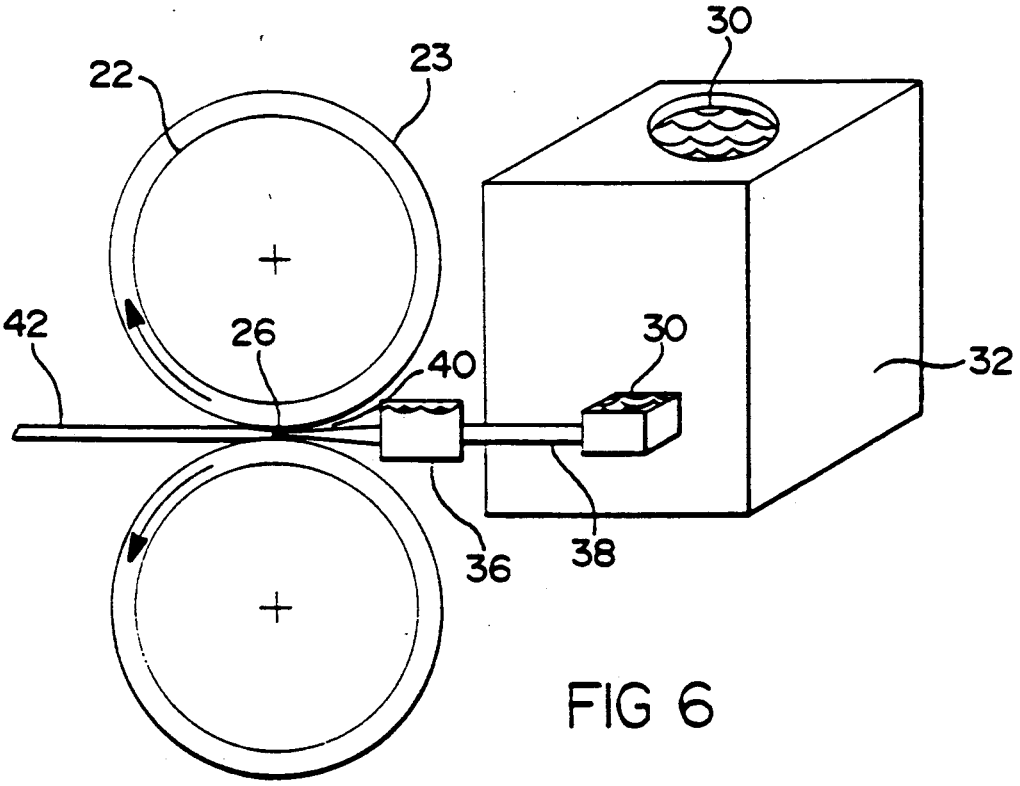
FIG. 6 is a schematic view of the apparatus required to cast the engine bearing alloy of the subject invention.

In the water-cooled roll-cast experiments, the molten alloy was introduced between the rolls at a point just upstream of the center line of the two rolls. FIG. 6 illustrates an apparatus for casting metallic strip in accordance with the present invention. This apparatus includes two water-cooled copper or copper alloy sleeved rolls (22) between which the strip (20) is cast.

Copper and copper alloys (preferably precipitation-hardened are chosen for their high thermal conductivity; however, steel brass, aluminum alloys, or other materials may also be used for the sleeves of the rolls. Likewise, cooling may be accomplished with the use of a medium other than water. Water is chosen for its high heat capacity, low cost and ready availability.

In the operation of the strip casting apparatus, the surface (24) of the casting rolls (22), must be able to absorb the heat generated by contact with molten metal at the initial casting point (26), and such heat must diffuse substantially through the copper sleeve to the cooling liquid during each rotation of the wheel. Cooling of the copper sleeve may be accomplished by delivering a sufficient quantity of water through internal passageways located near the periphery of the sleeve. Alternatively, the cooling medium may be delivered to the underside of the sleeve. Refrigeration may be used to increase cooling rates, but in the inventors' experience mere tap water at normal temperatures is adequate.

The casting surfaces should be generally smooth and symmetrical to maximize uniformity in strip casting.

The molten metal (30) to be cast in the apparatus described herein is preferably retained in an induction furnace (32), which is the preferred type of furnace because it provides stirring of the molten aluminum-lead alloy, thereby assisting in the dissolving of the lead. Metal is typically carried to a head box (36) through a tube (38) and introduced at the roll gap through an orifice (40) or nozzle. The rolls rotate at a surface speed of about 0.5-2.0 meters per minute, and the roll gap is held such as to produce a cast thickness between 4 to 7 mm. Solidified cast product is shown at (42). A cast and rolled engine bearing produced with this alloy will include in one case lead particles with a maximum dimension of 100 microns measured in any direction and in another case lead particles at or near the bearing surface with a length of predominantly less than 240 microns and with an average length of 40 microns, measured in the direction of their elongation during bonding.

Further details of the casting apparatus and its manner of operation are as disclosed in U.S. Pat. Nos. 2,790,216 and 2,850,776, the teachings thereof being incorporated herein by reference.

Obviously, numerous modifications and variations of the present invention are possible in the light of the above teachings. It is therefore to be understood that within the scope of the appended claims, the invention may be practiced otherwise than as specifically described herein.

We claim:

1. An aluminum-lead engine bearing alloy in continuously cast strip form with a lead content in excess of 4% by weight, in which the lead phase consists of uniformly distributed spherical particles averaging 2 to 12 microns in diameter and being no more than 25 microns in diameter, wherein the content of all remaining constituents other than aluminum totals not more than 10% by weight, the balance being aluminum.

2. The aluminum-lead engine bearing alloy of claim 1 wherein said lead particles are predominantly less than 5 microns in diameter.

3. An aluminum-lead-silicon engine bearing alloy in cast strip form with a lead content in excess of 4% by weight, in which the lead phase consists of uniformly distributed spherical particles no more than 25 microns in diameter and averaging 2 to 12 microns in diameter, with a silicon content of 2.5-5.5% by weight, and wherein the content of all remaining constituents other than aluminum totals not more than 5% by weight, the balance being aluminum.

4. An aluminum-lead-silicon engine bearing alloy in cast strip form with a lead content in excess of 4% by weight, in which the lead phase consists of uniformly distributed spherical particles predominantly less than 5 microns in diameter, with a silicon content of 2.5-5.5% by weight, and wherein the content of all remaining constituents other than aluminum totals not more than 5% by weight, the balance being aluminum.

5. An engine bearing composite comprising an aluminum-lead alloy lining bonded to a steel backing, the aluminum-lead alloy being a cast-and-rolled product, not having entrained oxide typical of an aluminum product produced from powdered metal, and having a lead content in excess of 4% by weight, and in which there is no significant gradient of lead through the thickness of the lining, and in which the maximum dimension of the lead particles measured in any direction is 100 microns.

6. An engine bearing composite comprising an aluminum-lead-silicon alloy lining bonded to a steel backing, the aluminum-lead-silicon alloy being a cast-and-rolled product, not having entrained oxide typical of an aluminum product produced from powdered metal, and having a lead content in excess of 4% by weight, and having a silicon content between 2.5 and 5.5% by weight, and in which there is no significant gradient of lead through the thickness of the lining, and in which the lead particles at and near the bearing surface are predominantly less than 240 microns in length and average 40 microns, measured in the direction of their elongation during bonding.

7. A process for continuously casting an aluminum-lead bearing alloy, as defined in any of claims 1–4, at a thickness of 1–10 mm, said process including:

holding said alloy in molten form in a furnace, introducing said molten alloy between two rotating metallic rolls, each cooled on its inside surface by a coolant, at a point upstream of the centerline of the two rolls, thereby cooling said molten alloy from a temperature in excess of 850° C. to a solidification temperature of 650° C. in less than 1 second.

8. A process as defined in claim 3 in which the said cooling is obtained by feeding the molten alloy upstream of the centerline of two water-cooled precipitation-hardened copper rolls rotating at a surface speed of 0.5–2.0 meters/minute, and in which the separation of the rolls is such as to produce a cast thickness between 4 and 7 mm.

9. The aluminum-lead engine bearing alloy of claim 1 wherein the lead content is between about 4% and about 10% by weight.

* * * * *